US009145758B2

(12) United States Patent
King

(10) Patent No.: US 9,145,758 B2
(45) Date of Patent: Sep. 29, 2015

(54) SLEEVED BALL SEAT

(75) Inventor: James G. King, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 763 days.

(21) Appl. No.: 13/156,995

(22) Filed: Jun. 9, 2011

(65) Prior Publication Data

US 2012/0312557 A1 Dec. 13, 2012

(51) Int. Cl.

| | |
|---|---|
| ***E21B 34/14*** | (2006.01) |
| ***E21B 34/10*** | (2006.01) |
| *E21B 34/00* | (2006.01) |

(52) U.S. Cl.

CPC ..... *E21B 34/103* (2013.01); *E21B 2034/007* (2013.01)

(58) Field of Classification Search

CPC . E21B 34/14; E21B 21/103; E21B 2034/007; E21B 34/103; E21B 23/00

USPC ..... 166/318

See application file for complete search history.

(56) References Cited

U.S. PATENT DOCUMENTS

| | | | |
|---|---|---|---|
| 1,883,071 | A | 10/1932 | Stone |
| 2,117,539 | A | 5/1938 | Baker et al. |
| 2,769,454 | A | 11/1956 | Bletcher et al. |
| 2,822,757 | A | 2/1958 | Coberly |
| 2,829,719 | A | 4/1958 | Clark, Jr. |
| 2,857,972 | A | 10/1958 | Baker et al. |
| 2,973,006 | A | 2/1961 | Nelson |
| 3,007,527 | A | 11/1961 | Nelson |
| 3,013,612 | A | 12/1961 | Angel |
| 3,043,903 | A | 7/1962 | Keane et al. |
| 3,090,442 | A | 5/1963 | Cochran et al. |
| 3,211,232 | A | 10/1965 | Grimmer |

(Continued)

FOREIGN PATENT DOCUMENTS

| | | |
|---|---|---|
| CA | 2460712 | 4/2005 |
| EP | 0518371 A3 | 12/1992 |

(Continued)

OTHER PUBLICATIONS

D.W. Thomson, et al., Design and Installation of a Cost-Effective Completion System for Horizontal Chalk Wells Where Multiple Zones Require Acid Stimulation, SPE Drilling & Completion, Sep. 1998, pp. 151-156, Offshore Technology Conference, U.S.A.

(Continued)

*Primary Examiner* — Shane Bomar
*Assistant Examiner* — Kipp Wallace
(74) *Attorney, Agent, or Firm* — Parsons Behle & Latimer

(57) ABSTRACT

Apparatuses for restricting fluid flow through a conduit comprise a seat sleeve disposed in a housing, the housing being disposed in a tubular member. The seat sleeve comprises a seat and one or more ports in fluid communication with a seat sleeve bore. One or more seat bypass fluid flow channels are disposed in the housing and are initially placed in fluid communication with at least one of the seat sleeve ports. Landing a plug element on the seat blocks fluid flow through the seat, but fluid flow is permitted to flow through the seat bypass fluid flow channels, through the seat sleeve ports, and into the seat sleeve bore. Movement of the seat sleeve downward closes the seat sleeve ports. Thus, a plug element can restrict fluid flowing through an area of the apparatus that is larger than the plug element.

19 Claims, 5 Drawing Sheets

(56) References Cited

U.S. PATENT DOCUMENTS 3,220,481 A 11/1965 Park
3,220,491 A 11/1965 Mohr
3,503,445 A 3/1970 Cochrum et al.
3,510,103 A 5/1970 Carsello
3,566,964 A 3/1971 Livingston
3,667,505 A 6/1972 Radig
3,727,635 A 4/1973 Todd
3,776,258 A 12/1973 Dockins, Jr.
3,901,315 A 8/1975 Parker et al.
4,114,694 A 9/1978 Dinning
4,160,478 A 7/1979 Calhoun et al.
4,194,566 A 3/1980 Maly
4,291,722 A 9/1981 Churchman
4,292,988 A * 10/1981 Montgomery ..... 137/68.17
4,311,163 A 1/1982 Langevin
4,314,608 A 2/1982 Richardson
4,374,543 A 2/1983 Richardson
4,390,065 A 6/1983 Richardson
4,448,216 A 5/1984 Speegle et al.
4,478,279 A 10/1984 Puntar et al.
4,510,994 A 4/1985 Pringle
4,520,870 A 6/1985 Pringle
4,537,255 A 8/1985 Regalbuto et al.
4,537,383 A 8/1985 Fredd
4,576,234 A 3/1986 Upchurch
4,583,593 A 4/1986 Zunkel et al.
4,648,448 A * 3/1987 Sanford et al. ..... 166/187
4,669,538 A 6/1987 Szarka
4,729,432 A 3/1988 Helms
4,823,882 A 4/1989 Stokley et al.
4,826,135 A 5/1989 Mielke
4,828,037 A 5/1989 Lindsey et al.
4,848,691 A 7/1989 Muto et al.
4,862,966 A 9/1989 Lindsey et al.
4,893,678 A 1/1990 Stokley et al.
4,915,172 A 4/1990 Donovan et al.
4,949,788 A 8/1990 Szarka et al.
4,991,654 A 2/1991 Brandell et al.
5,056,599 A 10/1991 Comeaux et al.
5,146,992 A 9/1992 Baugh
5,244,044 A 9/1993 Henderson
5,246,203 A 9/1993 McKnight et al.
5,297,580 A 3/1994 Thurman
5,309,995 A 5/1994 Gonzalez et al.
5,333,689 A 8/1994 Jones et al.
5,335,727 A 8/1994 Cornette et al.
5,413,180 A 5/1995 Ross et al.
5,479,986 A 1/1996 Gano et al.
5,501,276 A 3/1996 Weaver et al.
5,558,153 A 9/1996 Holcombe et al.
5,577,560 A 11/1996 Coronado et al.
5,607,017 A 3/1997 Owens et al.
5,623,993 A 4/1997 Van Buskirk et al.
5,685,372 A 11/1997 Gano
5,704,393 A 1/1998 Connell et al.
5,709,269 A 1/1998 Head
5,762,142 A 6/1998 Connell et al.
5,765,641 A 6/1998 Shy et al.
5,813,483 A 9/1998 Latham et al.
5,960,881 A 10/1999 Allamon et al.
5,992,289 A 11/1999 George et al.
6,003,607 A 12/1999 Hagen et al.
6,026,903 A 2/2000 Shy et al.
6,050,340 A 4/2000 Scott
6,053,248 A 4/2000 Ross
6,053,250 A 4/2000 Echols
6,062,310 A 5/2000 Wesson et al.
6,076,600 A 6/2000 Vick, Jr. et al.
6,079,496 A 6/2000 Hirth
6,102,060 A 8/2000 Howlett et al.
6,155,350 A 12/2000 Melenyzer
6,161,622 A 12/2000 Robb et al.
6,189,618 B1 2/2001 Beeman et al.
6,220,350 B1 4/2001 Brothers et al.
6,279,656 B1 8/2001 Sinclair et al.
6,289,991 B1 9/2001 French
6,293,517 B1 9/2001 Cunningham
6,382,234 B1 5/2002 Birkhead et al.
6,397,950 B1 6/2002 Streich et al.
6,431,276 B1 8/2002 Robb et al.
6,457,517 B1 10/2002 Goodson et al.
6,467,546 B2 10/2002 Allamon et al.
6,530,574 B1 3/2003 Bailey et al.
6,547,007 B2 4/2003 Szarka et al.
6,634,428 B2 10/2003 Krauss et al.
6,666,273 B2 12/2003 Laurel
6,668,933 B2 12/2003 Kent
6,708,946 B1 3/2004 Edwards et al.
6,779,600 B2 8/2004 King et al.
6,834,726 B2 12/2004 Giroux et al.
6,848,511 B1 2/2005 Jones et al.
6,866,100 B2 3/2005 Gudmestad et al.
6,896,049 B2 5/2005 Moyes
6,926,086 B2 8/2005 Patterson et al.
6,966,368 B2 11/2005 Farquhar
7,021,389 B2 4/2006 Bishop et al.
7,093,664 B2 8/2006 Todd et al.
7,150,326 B2 12/2006 Bishop et al.
7,311,118 B2 12/2007 Doutt
7,325,617 B2 2/2008 Murray
7,350,582 B2 4/2008 McKeachnie et al.
7,353,879 B2 4/2008 Todd et al.
7,395,856 B2 7/2008 Murray
7,416,029 B2 8/2008 Telfer et al.
7,464,764 B2 12/2008 Xu
7,469,744 B2 12/2008 Ruddock et al.
7,503,392 B2 3/2009 King et al.
7,625,846 B2 12/2009 Cooke, Jr.
7,628,210 B2 12/2009 Avant et al.
7,640,991 B2 1/2010 Leising
7,644,772 B2 1/2010 Avant et al.
8,276,675 B2 10/2012 Williamson et al.
2002/0162661 A1 11/2002 Krauss et al.
2003/0037921 A1 2/2003 Goodson
2003/0141064 A1 7/2003 Roberson, Jr.
2003/0168214 A1 9/2003 Sollesnes
2004/0108109 A1 6/2004 Allamon et al.
2005/0061372 A1 3/2005 McGrath et al.
2005/0092363 A1 5/2005 Richard et al.
2005/0092484 A1 5/2005 Evans
2005/0126638 A1 6/2005 Gilbert
2005/0161224 A1 7/2005 Starr et al.
2005/0205264 A1 9/2005 Starr et al.
2005/0205265 A1 9/2005 Todd et al.
2005/0205266 A1 9/2005 Todd et al.
2005/0281968 A1 12/2005 Shanholtz et al.
2006/0021748 A1 2/2006 Swor et al.
2006/0131031 A1 6/2006 McKeachnie et al.
2006/0175092 A1 8/2006 Mashburn
2006/0213670 A1 9/2006 Bishop et al.
2006/0243455 A1 11/2006 Telfer et al.
2006/0266518 A1 11/2006 Woloson
2007/0023087 A1 2/2007 Krebs et al.
2007/0029080 A1 2/2007 Moyes
2007/0062706 A1 3/2007 Leising
2007/0074873 A1 4/2007 McKeachnie et al.
2007/0169935 A1 7/2007 Akbar et al.
2007/0295507 A1 12/2007 Telfer
2008/0017375 A1 1/2008 Wardley
2008/0066923 A1 3/2008 Xu
2008/0066924 A1 3/2008 Xu
2008/0217025 A1 9/2008 Ruddock et al.
2009/0025927 A1 1/2009 Telfer
2009/0044946 A1 2/2009 Schasteen et al.
2009/0044948 A1 2/2009 Avant et al.
2009/0044949 A1 2/2009 King et al.
2009/0044955 A1 2/2009 King et al.
2009/0107684 A1 4/2009 Cooke, Jr.
2010/0032151 A1 2/2010 Duphorne
2010/0132954 A1 6/2010 Telfer
2010/0252280 A1 10/2010 Swor et al.
2011/0187062 A1 8/2011 Xu
2011/0192607 A1 8/2011 Hofman et al.
2011/0315390 A1 12/2011 Guillory et al.

(56) References Cited

U.S. PATENT DOCUMENTS

| | | | |
|---|---|---|---|
| 2012/0012771 | A1 | 1/2012 | Korkmaz et al. |
| 2012/0048556 | A1 | 3/2012 | O'Connell et al. |
| 2012/0199341 | A1 | 8/2012 | Kellner et al. |
| 2012/0227980 | A1 | 9/2012 | Fay |
| 2012/0261115 | A1 | 10/2012 | Xu |
| 2012/0261140 | A1 | 10/2012 | Xu |
| 2012/0305236 | A1 | 12/2012 | Gouthaman |
| 2013/0140479 | A1 | 6/2013 | Solfronk et al. |
| 2013/0146144 | A1 | 6/2013 | Joseph et al. |

FOREIGN PATENT DOCUMENTS

| | | | |
|---|---|---|---|
| WO | WO/02 068793 | A1 | 9/2002 |
| WO | WO 03006787 | A1 | 1/2003 |

OTHER PUBLICATIONS

H.A. Nasr-El-Din, et al., Laboratory Evaluation Biosealers, Feb. 13, 2001, pp. 1-11, SPE 65017, Society of Petroleum Engineers Inc., U.S.A.

Baker Hughes Incorporated. Model "E" Hydro-Trip Pressure Sub, Product Family No. H79928, Sep. 25, 2003, pp. 1-4, Baker Hughes Incorporated, Houston, Texas USA.

Innicor Completion Systems, HydroTrip Plug Sub, Product No. 658-0000, Jul. 26, 2004, p. 1, Innicor Completion Systems, Canada.

K.L. Smith, et al., "Ultra-Deepwater Production Systems Technical Progress Report," U.S. Department of Energy, Science and Technical Information, Annual Technical Progress Report, Jan. 2005, pp. 1-32, ConocoPhillips Company, U.S.A.

X. Li, et al., An Integrated Transport Model for Ball-Sealer Diversion in Vertical and Horizontal Wells, Oct. 9, 2005, pp. 1-9, SPE 96339, Society of Petroleum Engineers, U.S.A.

G.L. Rytlewski, A Study of Fracture Initiation Pressures in Cemented Cased Hole Wells Without Perforations, May 15, 2006, pp. 1-10, SPE 100572, Society of Petroleum Engineers, U.S.A.

StageFRAC Maximize Reservoir Drainage, 2007, pp. 1-2, Schlumberger, U.S.A.

Brad Musgrove, Multi-Layer Fracturing Solution Treat and Produce Completions, Nov. 12, 2007, pp. 1-23, Schlumberger, U.S.A.

* cited by examiner

SLEEVED BALL SEAT

BACKGROUND

1. Field of Invention

The present invention is directed to plug member seats for use in oil and gas wells and, in particular, to plug member seats having a seat sleeve that allows a plug element landing on the seat of the seat sleeve to block an area of fluid flow thorough the seat sleeve that is greater than the plug element landed on the seat sleeve.

2. Description of Art

Ball seats are generally known in the art. For example, typical ball seats have a bore or passageway that is restricted by a seat. The ball or drop plug is disposed on the seat, preventing or restricting fluid from flowing through the bore of the ball seat and, thus, isolating the tubing or conduit section in which the ball seat is disposed. As the fluid pressure above the ball or drop plug builds up, the conduit can be pressurized for tubing testing, actuating a tool connected to the ball seat such as setting a packer, or stimulating a wellbore. Ball seats are also used in cased hole completions, liner hangers, flow diverters, frac systems, and flow control equipment and systems.

Although the terms "ball seat" and "ball" may be used herein, it is to be understood that a drop plug or other shaped plugging device or element may be used with the "ball seats" disclosed and discussed herein. For simplicity it is to be understood that the term "ball" includes and encompasses all shapes and sizes of plugs, balls, or drop plugs unless the specific shape or design of the "ball" is expressly discussed.

SUMMARY OF INVENTION

Broadly, ball seats having a housing and a seat sleeve are disclosed. The seat sleeve comprises a seat sleeve bore that is fluid communication with the seat that receives the plug element or ball. The seat sleeve also includes one or more ports in fluid communication with one or more seat bypass channels disposed in the housing for fluid flow around the seat. Thus, when the seat sleeve is in the run-in position and a plug element has not been landed on the seat, fluid flows through the seat into the seat sleeve bore, and through each of the seat bypass channels, though the seat sleeve ports, and into the seat sleeve bore. The area open for fluid to flow through the seat sleeve in this position is referred to herein as the "initial fluid flow area." The term "area" as used herein means the combined geometric area(s) of the cross-section(s) of the opening(s) allowing fluid to flow through the seat sleeve.

After a plug element is landed on the seat, fluid flow through the seat is restricted, however, until sufficient pressure builds above the seat sleeve, the seat sleeve remains in the run-in position and fluid flow continues to flow through the seat bypass channels, through the seat sleeve ports, and into the seat sleeve bore. The area open for fluid flow through the seat sleeve in this position is referred to herein as the "seat bypass channel fluid flow area."

After the pressure above the seat sleeve increases sufficient to move the seat sleeve downward toward the set position of the seat sleeve, fluid flow through each of the seat sleeve ports begins to be restricted. As a result, the pressure above the seat increases so that a downhole operation can be performed, e.g., actuation of a downhole tool or allowing stimulation fluids to be injected into a wellbore. In one particular embodiment, the pressure above the seat can continue to increase causing the seat sleeve to continue to move downward until each of the seat sleeve ports becomes completely blocked. However, it is to be understood that each of the seat sleeve ports is not required to become completely blocked. The area open for fluid flow through the seat sleeve in the positions in which the seat bypass channel(s) is/are partial blocked or completely blocked is referred to herein as "operational fluid flow area" because at this point, the downhole operation can be performed. Because the initial fluid flow area is larger than the cross-sectional area of the opening through the seat on which the plug element lands, a plug element having a can be used to partially or completely block a fluid flow area that is larger than the fluid flow area through the seat. In other words, the apparatus allows a plug element such as a ball to close off fluid flow paths that have a combined fluid flow area that is greater than the size of the plug element, e.g., the diameter of the ball.

Figure 1:
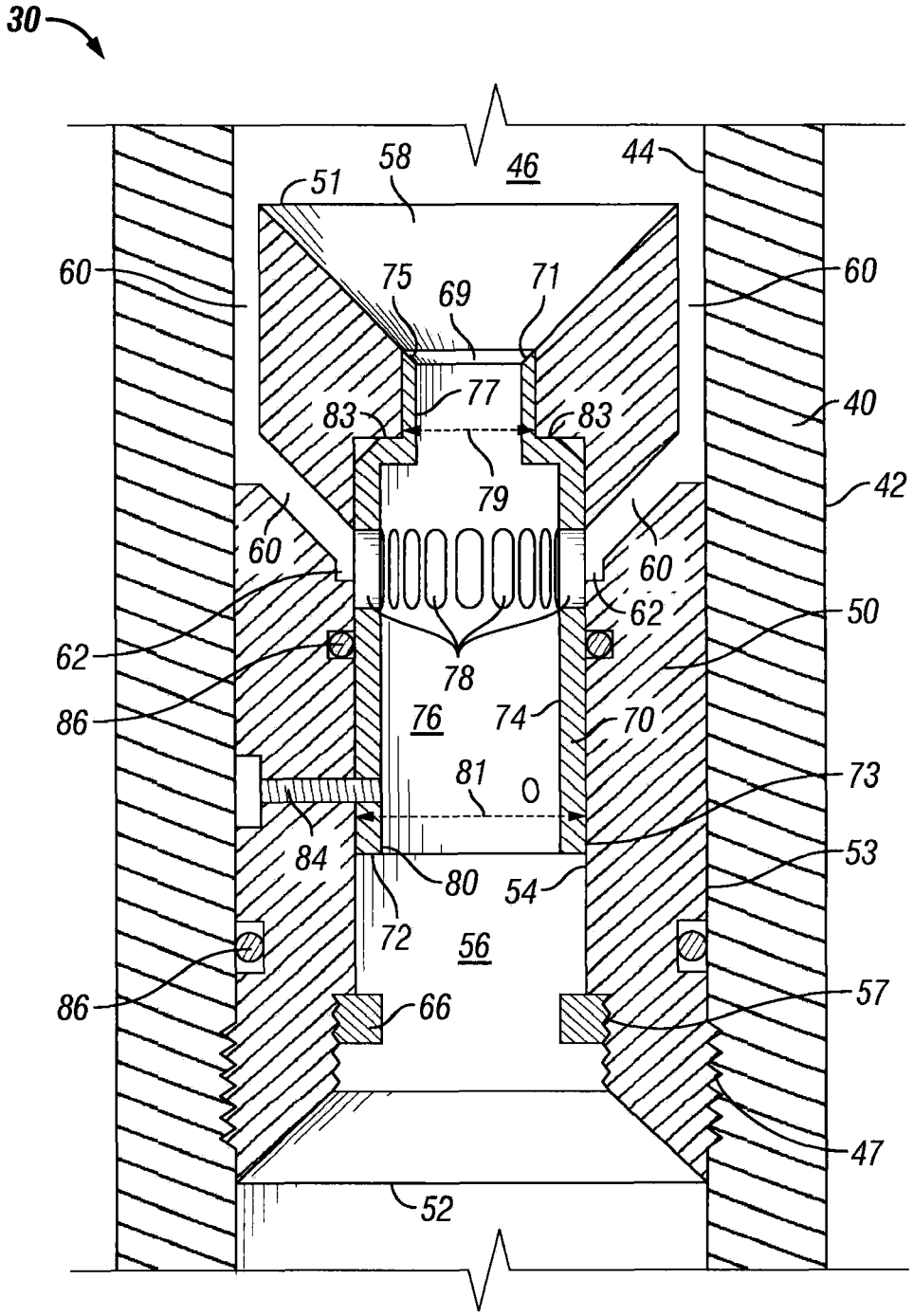
FIG. 1 is a partial cross-sectional view of a specific embodiment of a ball seat disclosed herein shown in the run-in position.
Figure 2:
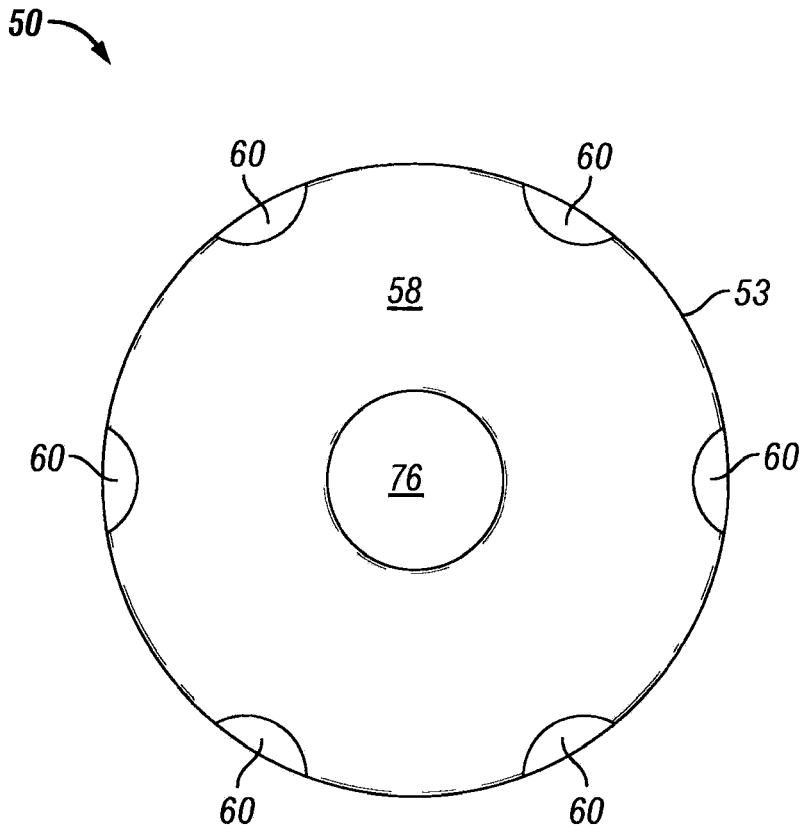
FIG. 2 is a top view of the seat sleeve disposed in the ball seat shown in FIG. 1.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-4, in one embodiment, apparatus 30 includes tubular member 40 having outer wall surface 42 and inner wall surface 44 defining bore 46. Attachment members such as threads (not shown) can be disposed along inner wall surface 44 or outer wall surface 42 of tubular member 40 at the upper and lower ends of tubular member 40 for securing apparatus 30 to a string of conduit, such as a work string or string of tubing.

Disposed within bore 46 and secured to inner wall surface 44, such as by threads 47, is housing 50. Housing 50 comprises upper end 51, lower end 52, outer wall surface 53, and inner wall surface 54 defining housing bore 56. As shown in the embodiment of FIGS. 1-4, upper end 51 comprises a funnel-shape 58 for facilitating plug element 90 landing on seat 75 of seat sleeve 70 discussed in greater detail below. Housing 50 also includes one or more seat bypass fluid flow channels 60 in fluid communication with upper end 51 and housing bore 56. At the intersection of seat bypass fluid flow channels 60 with housing bore 56 is gallery 62 to facilitating fluid flowing through seat sleeve ports 78 into seat sleeve bore 76 as discussed in greater detail below. In one embodiment, gallery 62 is in fluid communication with each seat bypass fluid flow channel 60 so that each seat bypass fluid flow channel is in fluid communication with each seat sleeve port 78. In other embodiments, two or more galleries 62 may place less than all of seat bypass fluid flow channels 60 in fluid communication with less than all of the seat sleeve ports 78. In still other embodiments, gallery 62 places one seat bypass fluid flow channel 60 in fluid communication with one seat sleeve port 78.

Stop or detent 66 is disposed on inner wall surface 54 toward lower end 52 of housing 50. Detent 66 restricts downward movement of seat sleeve 70. Detent 66 can be disposed at lower end 52 through any method or device known in the art. For example detent 66 can be secured to inner wall surface 54 by threads 57.

Disposed in housing bore 56 is seat sleeve 70. Seat sleeve 70 comprises upper end 71, lower end 72, outer wall surface 73, inner wall surface 74 defining seat sleeve bore 76, seat 75 and seat opening 69. Outer wall surface 73 of seat sleeve 70 is in sliding engagement with inner wall surface 54 of housing 50. Disposed between outer wall surface 73 and inner wall surface 74 and in fluid communication with seat sleeve bore 76 are ports 78. Although seat sleeve 70 is shown as having a plurality of seat sleeve ports 78, it is to be understood that seat sleeve 70 can have as few as one seat sleeve port 78.

Figure 3:
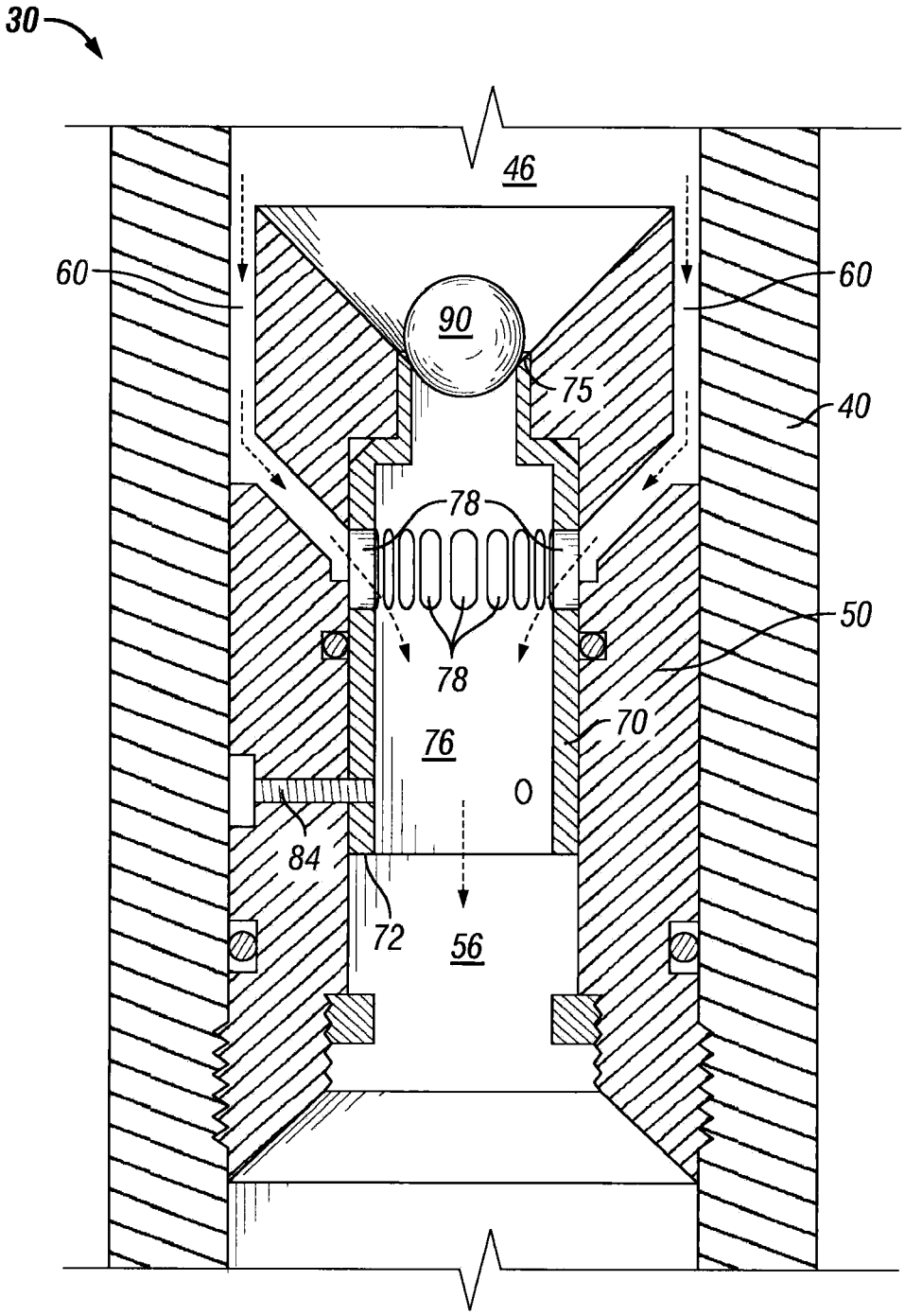
FIG. 3 is a partial cross-sectional view of the ball seat shown in FIG. 1 shown with a ball landed on the seat with the seat sleeve in the run-in position
Figure 4:
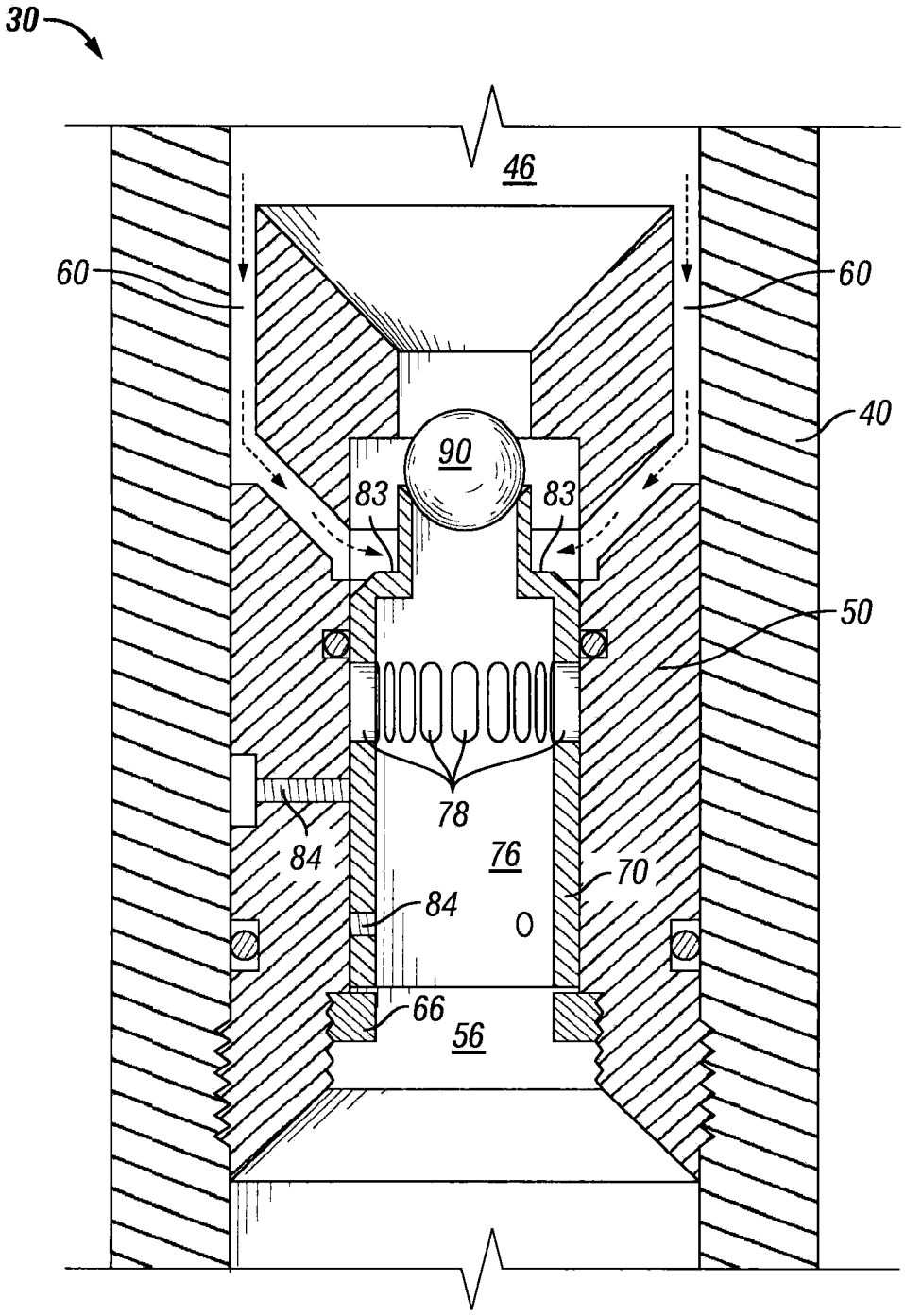
FIG. 4 is a partial cross-sectional view of the ball seat shown in FIG. 1 shown with the seat sleeve in the actuated or set position.

In the specific embodiment shown in FIGS. 1-4, seat sleeve 70 has an upper portion 77 having outer diameter 79 and lower portion 80 having outer diameter 81. Outer diameter 79 is less than outer diameter 81 so that seat sleeve has a throat or restricted seat sleeve bore 76 at upper end 71. As discussed in greater detail below, this arrangement provides surfaces 83 along outer wall surface 73 of seat sleeve 70 upon which fluid pressure can act to facilitate movement of seat sleeve 70 downward. As illustrated in FIGS. 1, 3, 4, upper portion outer diameter 79 provides an upper portion outer diameter wall surface, lower portion outer diameter 81 provides a lower portion outer diameter wall surface, and surfaces 83 are defined by a transition surface outer diameter. Surfaces 83 connect the upper portion outer diameter wall surface and the lower portion outer diameter wall surface so that fluid flowing through seat bypass fluid flow channels 60 acts on the surfaces 83 when seat sleeve 70 is moved from the first position (FIGS. 1, 3) toward the second position (FIG. 4) to facilitate downward movement of seat sleeve 70.

As discussed in greater detail below, seat sleeve 70 comprises first or run-in position (FIGS. 1 and 3) and second or actuated or set position (FIG. 4) and a plurality of intermediate positions (not shown). As illustrated in the FIG. 4, when seat sleeve 70 is in the second or set position, all of seat sleeve ports 78 are completely blocked. It is to be understood, however, that seat sleeve 70 can be in the second position, yet fluid flow is permitted to flow through one or more of seat sleeve ports 78 provided that the pressure built up above seat sleeve 70 is sufficient to perform the desired downhole operation.

In the particular embodiment shown in FIGS. 1-4, the initial fluid flow area is defined by the cross-sectional area of the smaller of opening 69, seat 75, or the inner diameter area of lower portion 80, together with the cross-sectional area of the smaller of seat bypass channels 60 or seat sleeve ports 78, when apparatus 30 is in the configuration shown in FIG. 1, i.e., plug element 90 is not landed on seat 75. The seat bypass channel fluid flow area is defined by the cross-sectional area of the smaller of seat bypass channels 60 of seat sleeve ports 78 when apparatus 30 is in the configuration shown in FIG. 3, i.e., plug element 90 is landed on seat 75, but seat sleeve 70 remains in the first or run-in position. The operational fluid flow area is defined by the cross-sectional area of the smaller of seat bypass channels 60 of seat sleeve ports 78 when apparatus 30 is in the second or set or actuated position such as shown in FIG. 4, i.e., seat sleeve 70 is in the second position. In the embodiment of FIGS. 1-4, the operational fluid flow area is zero because all fluid flow through opening 69 and seat ports 78 is completely blocked.

In the embodiment of FIGS. 1-4, seat sleeve 70 is retained in the first or run-in position by a retaining member shown as shear screw 84. Shear screw 84 prevents seat sleeve 70 from moving from the first position until a sufficient pressure is reached above seat sleeve 70 forcing seat sleeve 70 downward. Upon shear screw 84 breaking or shearing, seat sleeve 70 is then permitted to move toward the second position.

To reduce the likelihood of leak paths forming between tubular member 40 and housing 50 and between housing 50 and seat sleeve 70, seals 86 are disposed in grooves or recesses as illustrated in FIGS. 1, 3, 4.

In operation, housing 50 comprising seat sleeve 70 is disposed within bore 46 of tubular member 40. Tubular member 40 is included as part of a tubing or work string or conduit that is then disposed within a wellbore. Upon locating apparatus 30 at the desired location within the wellbore, plug element 90, shown as a ball, is dropped down the tubing string or conduit and landed on seat 75 (FIG. 3), restricting fluid flow through opening 69. Fluid continues to be permitted to flow through seat bypass fluid flow channels 60, through seat sleeve ports 78, into seat sleeve bore 76, out lower end 72, and into housing bore 56 as indicated by the arrows in FIG. 3.

After landing plug element 90 on seat 75, fluid pressure above seat sleeve 70 increases forcing plug element 90 into seat 75. Upon reaching a predetermined pressure, shear screw 84 breaks or shears and seat sleeve 70 begins moving from the first or run-in position (FIGS. 1, 3) toward the second position (FIG. 4). In so doing, seat sleeve ports 78 become restricted causing pressure above seat sleeve 70 to increase further. In one particular embodiment, this increase in pressure above seat sleeve 70 is sufficient to perform a downhole operation even though some fluid flow continues through seat bypass fluid flow channels 60, through seat sleeve ports 78, and into seat sleeve bore 76. Thus, the second position is reached even though all fluid flow through seat sleeve ports 78 may not have stopped. In one such embodiment, detent 66 can be disposed at a location along inner wall surface 54 such that downward movement of seat sleeve 70 is stopped even though fluid flow continues through one or more of seat sleeve ports 78. Alternatively, the downhole operation can be performed even though seat sleeve 70 has not reached detent 66. Thus, in one specific method, two different pressure ratings could result in two different downhole operations being performed through downward movement of seat sleeve 70. One operation could be performed before all seat sleeve ports 78 are blocked and another operation could be performed after all seat sleeve ports 78 are blocked.

In another specific embodiment, the downhole operation is not performed until all of seat sleeve ports 78 are completely blocked such as shown in FIG. 4. In this embodiment, seat sleeve 70 continues to move downward until lower end 72 engages detent 66. In so doing, surfaces 83 are placed in fluid communication with seat bypass fluid flow channels 60. Accordingly, as indicated by the arrows in FIG. 4, fluid flowing into housing bore 46 above housing 50 and seat sleeve 70 is forced into seat bypass fluid flow channels 60 and into housing bore 56 above surfaces 83. The fluid acts against surfaces 83 forcing seat sleeve 70 downward. Therefore, seat sleeve 70 is forced downward by downward pressure acting on plug element 90 and by downward pressure acting on surfaces 83 until seat sleeve 70 engages detent 66.

After performance of a downhole operation by restricting fluid flow through apparatus 30, restriction of fluid flow through apparatus 30 may no longer necessary. Accordingly, plug element 90 can be removed through methods and using devices known to persons of ordinary skill in the art, e.g., milling, dissolving, or fragmenting plug element 90. Alternatively, plug element 90 may be a lightweight "float" plug element such that, when pressure is reduced, plug element 90 is permitted to float up to the top of the well. In addition, housing 50 and seat sleeve 70 can be milled out of tubular member 40 so that fluid can flow through tubular member bore 46 unrestricted by housing 50 and seat sleeve 70.

Figure 5:
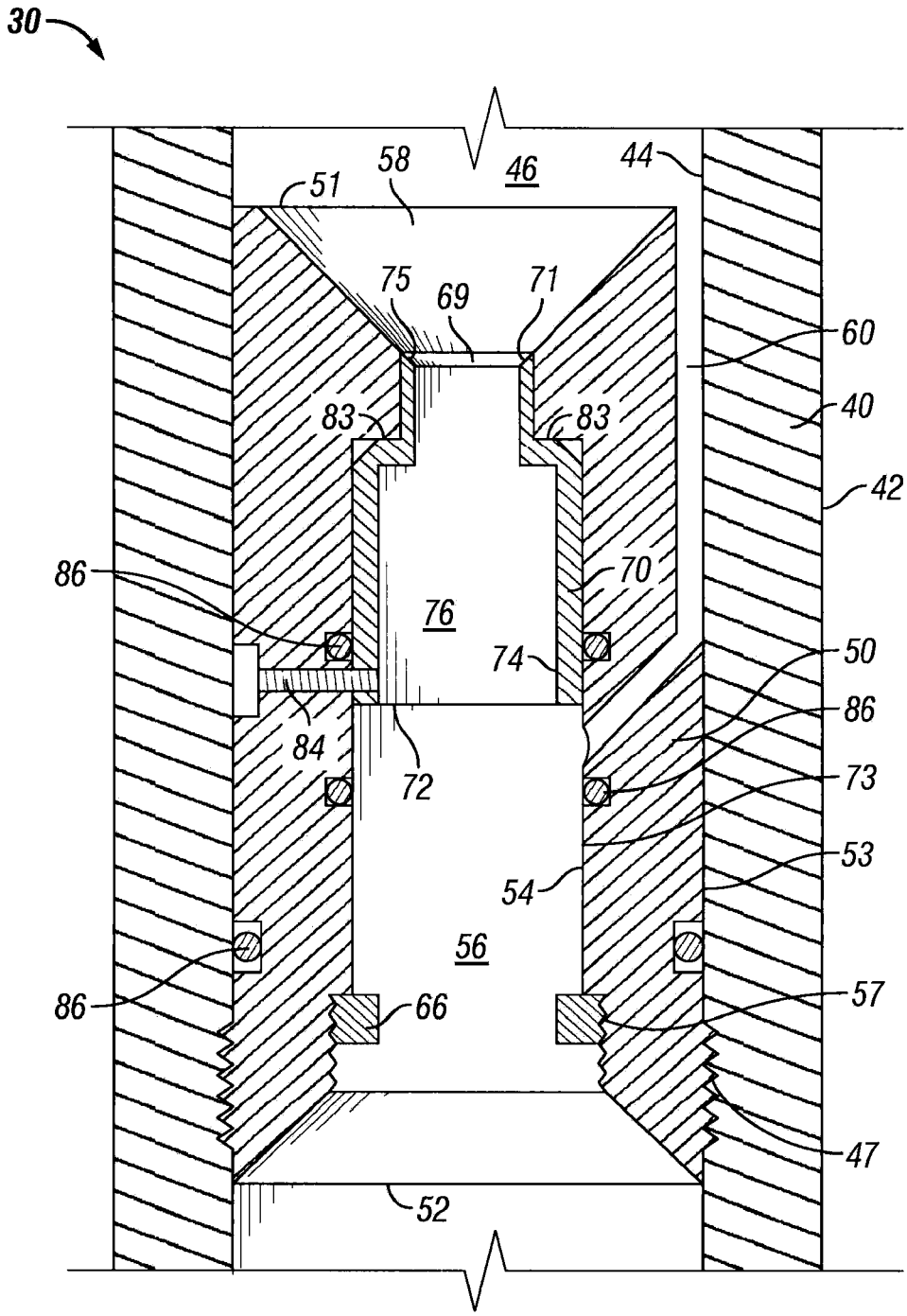
FIG. 5 is a partial cross-sectional view of another specific embodiment of a ball seat disclosed herein shown in the run-in position.

Referring now to FIG. 5, in another embodiment apparatus 130 comprises the same structural components with like reference numerals as the embodiment of FIGS. 1-4. Apparatus 130, however, does not include seat sleeve ports 78. Instead, seat bypass fluid flow channels 60 are in fluid communication with housing bore 56 below lower end 72 of seat sleeve 70 when apparatus 130 is in the run-in position. Thus, upon landing a plug element on seat 75, seat sleeve 70 moves downward to restrict fluid flow through seat bypass fluid flow channels by blocking at least a portion of the fluid communication between seat bypass fluid flow channels 60 and housing bore 56.

It is to be understood that the invention is not limited to the exact details of construction, operation, exact materials, or embodiments shown and described, as modifications and equivalents will be apparent to one skilled in the art. For example, the seat bypass fluid flow channels can have any shape desired or necessary to provide the secondary flow path. Although shown in the Figures as partial circles, the seat bypass fluid flow channels can have a full circle shape, square-shape, or polygonal-shape. In addition, the number of seat bypass fluid flow channels can be as low as one. Further, one or more of the seat bypass fluid flow channels can include a permeable matrix disposed within the channel. Similarly, the seat sleeve ports can have any shape desired or necessary to provide the secondary flow path and are not required to be elongated oval-shape as shown in the Figures. Nor are the seat sleeve ports required to be aligned with one or more of the seat bypass fluid flow channels. Moreover, the shape and size of the gallery can be modified and is not required to be in fluid communication with every seat bypass fluid flow channel.

Further, the size and shape of the plug element can be any size or shape desired or necessary to engage the seat of the seat sleeve to restrict fluid flow through the seat. Additionally, although the apparatuses described in greater detail with respect to the Figures are ball seats having a ball as their respective plug elements, it is to be understood that the apparatuses disclosed herein may be any type of seat known to persons of ordinary skill in the art that include a plug element. For example, the apparatus may be a drop plug seat, wherein the drop plug temporarily restricts the flow of fluid through the wellbore. Therefore, the term "plug" as used herein encompasses a ball as shown in the Figures, as well as any other type of device that is used to restrict the flow of fluid through a ball seat. Further, in all of the embodiments discussed with respect to the Figures, upward, toward the surface of the well (not shown), is toward the top of the Figures, and downward or downhole (the direction going away from the surface of the well) is toward the bottom of Figures. However, it is to be understood that the apparatuses may have their positions rotated. Accordingly, the apparatuses disclosed herein can be used in any number of orientations easily determinable and adaptable to persons of ordinary skill in the art. Accordingly, the invention is therefore to be limited only by the scope of the appended claims.

What is claimed is:

1. An apparatus of restricting fluid flow through a well conduit, the apparatus comprising:

a tubular member comprising an inner wall surface defining a longitudinal bore;

a seat housing having an inner wall surface and an outer wall surface, a majority of the outer wall surface disposed in the longitudinal bore, the seat housing comprising a seat housing bore and a seat bypass channel; and a seal placed radially between the tubular member and the seat housing to inhibit leakage therebetween;

a seat sleeve slidingly disposed within the seat housing bore, the seat sleeve comprising a first position, a second position, a seat for receiving a plug element to restrict fluid flow through an opening in the seat, an initial fluid flow area, a seat bypass channel fluid flow area, and an operational fluid flow area, wherein the initial fluid flow area is defined by the seat sleeve being in the first position without the plug element landed on the seat, and the seat bypass channel fluid flow area is defined by the seat sleeve being in the first position with the plug element landed on the seat, wherein landing the plug element on the seat causes the seat sleeve to move from the first position toward the second position causing restriction of fluid flow through the seat bypass channel thereby defining the operational fluid flow area, and wherein the initial fluid flow area is greater than the opening in the seat.

2. The apparatus of claim 1, wherein the initial fluid flow area is larger than a cross-sectional area of the plug element, the cross-sectional area of the plug element causing restriction of fluid flow through the seat.

3. The apparatus of claim 1, wherein the seat sleeve further comprises a seat sleeve port in fluid communication with the seat bypass channel when the seat sleeve is in the first position.

4. The apparatus of claim 3, wherein fluid flow through the seat sleeve port is completely blocked when the seat sleeve is in the second position.

5. The apparatus of claim 1, wherein the seat housing comprises a plurality of seat bypass channels, each of the plurality of seat bypass channels being in fluid communication the seat housing bore when the seat sleeve is in the first position, wherein fluid flow through each of the plurality of seat bypass channels is at least partially blocked when the seat sleeve is in the second position.

6. The apparatus of claim 5, wherein fluid flow through each of the plurality of seat bypass channels is completely blocked when the seat sleeve is in the second position.

7. The apparatus of claim 1, wherein the seat comprises a seat sleeve bore, the seat sleeve bore comprising an upper seat sleeve bore portion having a first outer diameter and a lower seat sleeve bore portion having a second outer diameter, the first outer diameter being smaller than the second outer diameter.

8. The apparatus of claim 1, wherein the seat sleeve comprises an upper portion comprising an upper portion outer diameter wall surface, a lower portion comprising a lower portion outer diameter wall surface, and a transition surface outer diameter, the transition outer diameter wall surface connecting the upper portion outer diameter wall surface and the lower portion outer diameter wall surface, wherein fluid flowing through the seat bypass channel fluid flow area acts on the transition outer diameter wall surface when the seat sleeve is moved from the first position toward the second position.

9. The apparatus of claim 1, wherein the seat housing bore further comprises a stop disposed below the seat sleeve, the seat sleeve engaging the stop when the seat sleeve is in the second position.

10. An apparatus of restricting fluid flow through a well conduit, the apparatus comprising:

a tubular member comprising an inner wall surface defining a longitudinal bore;

a seat housing disposed in the longitudinal bore, the seat housing comprising an upper end, a lower end, an outer wall surface, an inner wall surface defining a seat housing bore, and a seat bypass channel in fluid communication with the seat housing upper end and the seat housing bore;

a seat sleeve disposed in the seat housing bore and in sliding engagement with the inner wall surface, the seat sleeve comprising a first position, a second position, a seat sleeve upper end having a seat, a seat sleeve bore defining a seat sleeve inner wall surface, a seat sleeve outer wall surface, and a seat sleeve port disposed in the seat sleeve inner wall surface and the seat sleeve outer wall surface and in fluid communication with the seat sleeve bore, the seat sleeve port being in fluid communication with the seat bypass channel when the seat sleeve is in the first position; and a plug element adapted to be landed on the seat of the seat sleeve to restrict fluid flow through the seat sleeve bore causing the sleeve to move from the first position toward the second position, wherein movement of the seat sleeve from the first position to the second position causes restriction of fluid flow through the seat sleeve port.

11. The apparatus of claim 10, wherein the seat sleeve bore comprises a seat sleeve bore upper portion having a first outer diameter and a seat sleeve bore lower portion having a second outer diameter, the first outer diameter being smaller than the second outer diameter.

12. The apparatus of claim 10, wherein the seat housing bore further comprises a stop disposed below the seat sleeve, the seat sleeve engaging the stop when the seat sleeve is in the second position.

13. The apparatus of claim 10, wherein fluid flow through the seat sleeve port is completely blocked when the seat sleeve is in the second position.

14. The apparatus of claim 10, wherein the upper end of the seat housing comprises a funnel shape for facilitating the plug element landing on the seat of the seat sleeve.

15. The apparatus of claim 10, wherein the seat housing comprises a plurality of seat bypass channels, and the seat sleeve comprises a plurality of seat sleeve ports, wherein each of the plurality of seat bypass channels is in fluid communication with at least one seat sleeve port when the seat sleeve is in the first position, and wherein fluid flow through each of the plurality of seat sleeve ports is at least partially blocked when the seat sleeve is in the second position.

16. A method of restricting fluid flow through a well conduit to perform a downhole operation, the method comprising the steps of:

(a) providing an apparatus comprising a sleeve seat comprising a first position, a second position, a primary fluid flow path providing a primary fluid flow area through the sleeve seat, and a secondary fluid flow path providing a secondary fluid flow area through the sleeve seat, the primary and secondary fluid flow paths providing a combined initial fluid flow area through the sleeve seat;

(b) disposing the apparatus in a tubing string;

(c) disposing the tubing string in a wellbore;

(d) landing a plug element on the sleeve seat causing restriction of fluid flow through the primary fluid flow path, the plug element not restricting fluid flow through the secondary fluid flow path; then (e) moving the sleeve seat from the first position toward the second position causing restriction of fluid flow through the secondary fluid flow path by the sleeve seat, wherein the secondary fluid flow area is greater than the primary fluid flow area; and (f) performing a downhole operation when the seat sleeve is in the second position.

17. The method of claim 16, wherein the apparatus comprises a tubular member comprising an inner wall surface defining a longitudinal bore, a seat housing disposed in the longitudinal bore, the seat housing comprising a seat housing bore and a seat bypass channel, and the seat sleeve slidingly disposed within the seat housing bore, the seat sleeve comprising a seat opening, the seat opening providing the primary fluid flow path through the seat sleeve, a seat for receiving the plug element to restrict fluid flow through the seat opening, and a seat sleeve port in fluid communication with the seat bypass channel when the seat sleeve is in the first position, the seat sleeve port and seat bypass channel providing the secondary fluid flow path through the seat sleeve when the seat sleeve is in the first position, wherein landing the plug element on the seat causes the seat sleeve to move from the first position toward the second position causing restriction of fluid flow through the seat sleeve port.

18. The method of claim 16, wherein the combined initial fluid flow area through the sleeve seat is larger than a cross-sectional area of the plug element, the cross-sectional area of the plug element causing restriction of fluid flow through the primary fluid flow path.

19. The method of claim 16, wherein the primary fluid flow area is provided by a seat opening through the seat, and the secondary fluid flow area is provided by a plurality of seat sleeve ports disposed in the seat sleeve and a plurality of seat bypass channels disposed in a housing, the seat sleeve being disposed within the housing, wherein each of the plurality of seat bypass channels is in fluid communication with a at least one seat sleeve port when the seat sleeve is in the first position, and wherein fluid flow through each of the plurality of seat sleeve ports is at least partially blocked when the seat sleeve is in the second position.

* * * * *